US006098600A

United States Patent [19]

Umetsu et al.

[11] Patent Number: 6,098,600

[45] Date of Patent: Aug. 8, 2000

[54] FUEL SUPPLY SYSTEM

[75] Inventors: Kunihiro Umetsu, Anjo; Akiyoshi Mukaidani, Takahama, both of Japan

[73] Assignee: Denso Corporation, Japan

[21] Appl. No.: 09/201,657

[22] Filed: Dec. 1, 1998

[30] Foreign Application Priority Data

Dec. 2, 1997 [JP] Japan ..... 9/331788

[51] Int. Cl.[7] ..... F02M 37/04

[52] U.S. Cl. ..... 123/514; 417/79

[58] Field of Search ..... 123/510, 509, 123/514; 417/76, 77, 78, 79, 198, 80

[56] References Cited

U.S. PATENT DOCUMENTS

| | | | |
|---|---|---|---|
| 2,953,156 | 9/1960 | Druant | 419/79 |
| 3,134,338 | 5/1964 | Dodge | 417/198 |
| 3,895,885 | 7/1975 | Liberg | 417/80 |
| 4,019,834 | 4/1977 | Teodorescu | 417/198 |
| 4,704,070 | 11/1987 | Isiman | 417/80 |
| 4,810,170 | 3/1989 | Ide | 417/198 |
| 4,834,132 | 5/1989 | Sasaki | 123/514 |
| 4,869,225 | 9/1989 | Nagata et al. . | |
| 4,911,134 | 3/1990 | Olsson | 123/509 |
| 5,024,583 | 6/1991 | Sasaki | 417/198 |
| 5,133,724 | 7/1992 | Michiaki | 123/514 |
| 5,785,084 | 7/1998 | Richter | 123/514 |

FOREIGN PATENT DOCUMENTS

| | | | |
|---|---|---|---|
| 1-136671 U | of 0000 | Japan . | |
| 63-193000 | of 0000 | Japan . | |
| 7-304341 | of 0000 | Japan . | |
| 2266342 | 10/1993 | United Kingdom | 417/198 |

*Primary Examiner*—Carl S. Miller
*Attorney, Agent, or Firm*—Nixon & Vanderhye PC

[57] ABSTRACT

A fuel supply system has a fuel tank in which a sub-tank and a jet pump are installed. The jet pump has a fuel supply passage into which fuel returned from an engine of a vehicle is supplied, and a fuel injection passage having an injection hole at a fuel downstream end thereof. The fuel supply passage and the fuel injection passage are perpendicular to each other and are communicated with each other so that passage axes thereof do not cross each other. Therefore, fuel introduced into the fuel injection passage from the fuel supply passage swirls in the fuel injection passage. As a result, fuel injected into a fuel inlet passage of the sub-tank from the injection hole uniformly disperses over an entire cross-section of the fuel inlet passage, forming a fuel membrane. Therefore, fuel is continuously introduced into the sub-tank in opposition to a water head pressure of fuel in the sub-tank. Thus, fuel is prevented from being discharged from the sub-tank even when fuel in the fuel tank is decreased and does not exist around the jet pump.

16 Claims, 5 Drawing Sheets

FUEL SUPPLY SYSTEM

CROSS-REFERENCE TO RELATED APPLICATION

This application relates to and claims priority from Japanese Patent Application No. Hei. 9-331788 filed on Dec. 2, 1997, the entire contents of which are incorporated herein by reference.

BACKGROUND OF THE INVENTION

1. Field of the Invention

The present invention relates generally to fuel supply systems, and particularly to a vehicle engine fuel supply system, having a sub-tank in which a fuel pump is installed.

2. Related Art

JP-A-2-30971 discloses a fuel supply system for a vehicle engine having a fuel tank, a sub-tank in which a fuel pump is installed and a jet pump having an injection hole. In the fuel supply system, a fuel level in the sub-tank is maintained so that the fuel pump sufficiently sucks fuel from the sub-tank even when a fuel level in the fuel tank is lowered. Fuel returned from the engine is supplied to the jet pump which injects fuel into the sub-tank through the injection hole. When fuel is injected into the sub-tank, a negative pressure is generated around the injected fuel, and fuel in the fuel tank is also sucked into the sub-tank due to the negative pressure. Thus, fuel is constantly supplied to the sub-tank so that the fuel pump installed therein constantly sucks fuel from the sub-tank.

The sub-tank has a fuel inlet passage through which fuel injected by the jet pump and fuel from the fuel tank is introduced. A water head pressure corresponding to the fuel level in the sub-tank is constantly applied to the fuel inlet passage. When an amount of fuel remaining in the fuel tank is relatively large, fuel exists in a space around the injection hole of the jet pump in the fuel tank. Therefore, when fuel is injected into the fuel inlet passage by the jet pump, fuel is sucked into the fuel inlet passage due to the negative pressure and disperses over the entire cross-section of the fuel inlet passage along with the injected fuel. As a result, fuel in the sub-tank is prevented from being discharged through the fuel inlet passage toward the jet pump, and fuel in the fuel tank is introduced into the sub-tank in opposition to the water head pressure of the fuel in the sub-tank.

However, when the amount of fuel remaining in the fuel tank is decreased, and the vehicle is steered around a sharp curve or is driven on a road having a steep grade, fuel may not be dispose around the injection hole of the jet pump in the fuel tank. In this case, only fuel injected by the jet pump opposes the water head pressure of the fuel in the sub-tank. If fuel injected by the jet pump disperses insufficiently and a fuel membrane is not formed over the entire cross-section of the fuel inlet passage, fuel in the sub-tank may be discharged through a gap created between the fuel membrane and an inner wall of the fuel inlet passage. Further, if fuel is not continuously present in the space around the injection hole of the jet pump the amount of fuel in the sub-tank will greatly decrease.

Further, in the fuel supply system, a diameter of the fuel inlet passage is set relatively large (e.g., 10 mm) so that fuel in the fuel tank is spontaneously introduced into the sub-tank through the fuel inlet passage when fuel initially fills the fuel tank. When a fuel level in the fuel tank is higher than the fuel inlet passage, a gap between the injected fuel and an inner wall of the fuel inlet passage is filled with fuel. In this case, fuel is prevented from being discharged from the sub-tank although the injected fuel does not hit the inner wall of the fuel inlet passage.

Since an injection angle of fuel injected by the jet pump is relatively small, the injected fuel never contacts the inner wall of the fuel inlet passage. Therefore, when a fuel level in the fuel tank is as low as a bottom surface of the fuel tank and no fuel exists around the fuel inlet passage, a gap is created between the injected fuel and the inner wall of the fuel inlet passage. As a result, fuel in the sub-tank is discharged through the gap. Conventionally this only happens when the amount of fuel remaining in the fuel tank is extremely small. However, recently, a vehicle capable of being steered around with a maximum load with a small amount of fuel remaining in the fuel tank is in great demand. In such a vehicle, it is necessary to maintain the fuel level in the sub-tank even if the fuel level in the fuel tank is low.

SUMMARY OF THE INVENTION

The present invention is made in light of the foregoing problem, and it is an object of the present invention to provide a fuel supply system having a simple structure in which fuel is prevented from being discharged from a sub-tank even if the amount of fuel in a fuel tank decreases and fuel is not present around the injection hole of the jet pump.

It is another object of the present invention to provide a fuel supply system in which a fuel inlet passage of the sub-tank has a relatively large diameter so that fuel in a fuel tank is spontaneously introduced into the sub-tank through the fuel inlet passage, and an amount of fuel in the sub-tank is maintained even if the fuel level in the fuel tank decreases.

According to the present invention, a fuel supply apparatus has a jet pump for injecting fuel in a fuel tank to deliver fuel into a sub-tank through a fuel inlet passage by using a negative pressure generated by the such fuel injection. The jet pump has a reverse flow preventing unit for preventing fuel in the sub-tank from being discharged through the fuel inlet passage. As a result, the injected fuel uniformly disperses over an entire cross-section of the fuel inlet passage to form a fuel membrane, thereby preventing fuel from being discharged from the sub-tank. Thus, even when fuel in the fuel tank decreases and is not disposed around the injection hole of the jet pump, a fuel level in the sub-tank is maintained so that fuel is constantly supplied to the engine by the fuel pump.

According to another aspect of the present invention, the reverse flow pre venting unit has a swirl injection generating unit for generating a swirl of the fuel injection. As a result, the injected fuel uniformly disperses over an entire cross-section of the fuel inlet passage to form a fuel membrane, thereby preventing fuel from being discharged from the sub-tank.

BRIEF DESCRIPTION OF THE DRAWINGS

Additional objects an d advantages of the present invention will be more readily apparent from the following detailed description of a preferred embodiment when taken together with the accompanying drawings, in which.

DETAILED DESCRIPTION OF THE PREFERRED EMBODIMENTS

Embodiments of the present invention will be described hereinafter with reference to the accompanying drawings.

First Embodiment

Figure 1:
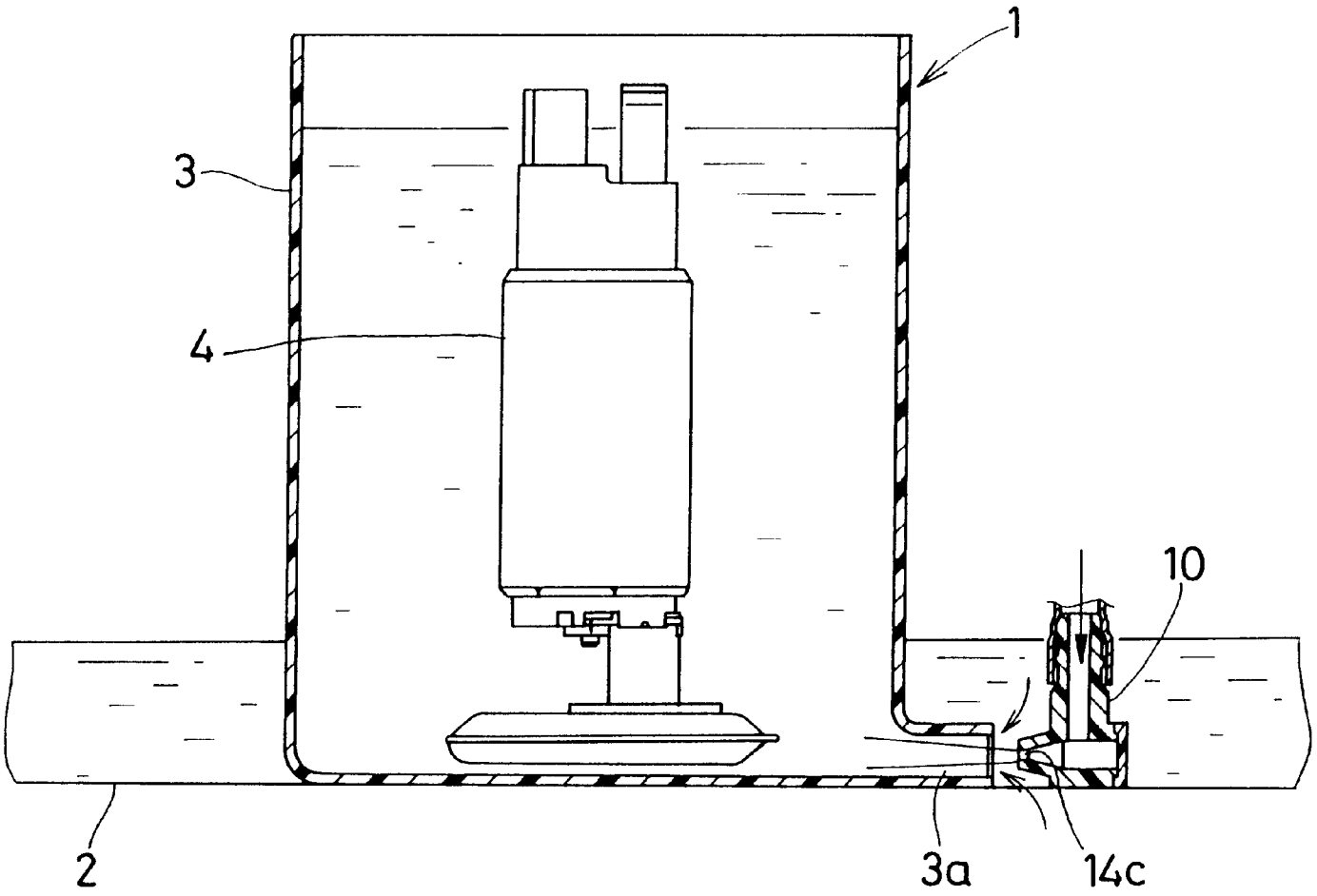
FIG. 1 is a schematic cross-sectional view showing a fuel supply system according to a first embodiment of the present invention.

As shown in FIG. 1, a fuel supply system 1 has a fuel tank 2 and a sub-tank 3 which is installed inside the fuel tank 2. A fuel pump 4 is disposed inside the sub-tank 3. A jet pump 10 is disposed outside the sub-tank 3, and is secured to the sub-tank 3 by a snap fastener or the like. The sub-tank 3 has a fuel inlet passage 3*a* formed at a bottom part of the sub-tank 3. Surplus fuel returned from an engine of a vehicle to the fuel tank 2 is injected by the jet pump 10 into the fuel inlet passage 3*a* through an injection hole 14*c* of the jet pump 10. When fuel is injected into the fuel inlet passage 3*a* from the injection hole 14*c*, a negative pressure is generated around the injected fuel. As a result, fuel in the fuel tank 2 is sucked into the fuel inlet passage 3*a*, and is introduced into the sub-tank 3 along with the injected fuel.

Figure 2A:
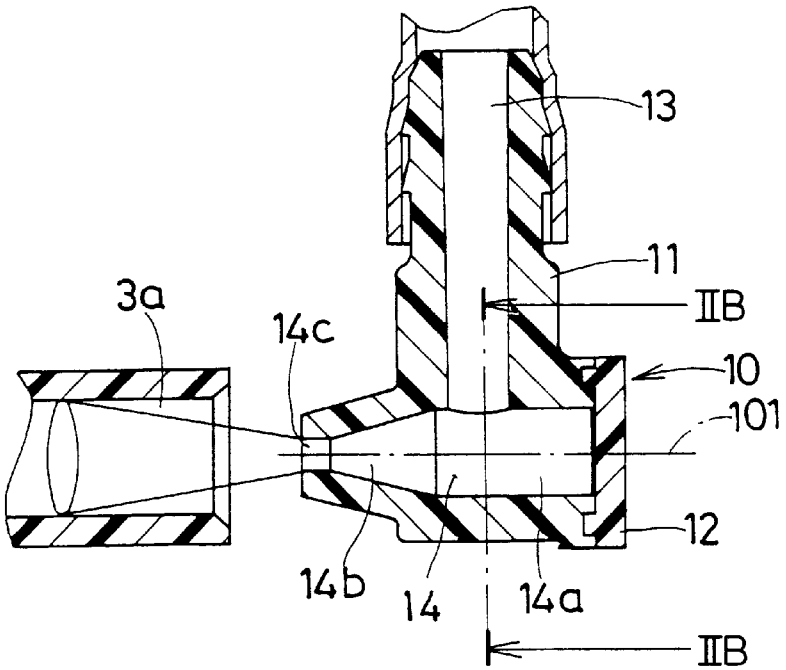
FIG. 2A is a cross-sectional view showing a jet pump and a fuel inlet passage of a sub-tank according to the first embodiment.

As shown in FIG. 2A, the jet pump 10 has a housing 11 and a lid 12 for closing the housing 11 at a rear end of the jet pump 10. The jet pump 10 has a fuel supply passage 13 through which fuel returned from the engine flows and a fuel injection passage 14. The fuel injection passage 14 has a communication portion 14*a* at which the fuel supply passage 13 is communicated with the fuel injection passage 14, a throttle portion 14*b* tapered toward a fuel downstream end of the throttle portion 14*b*, and the injection hole 14*c* formed at the fuel downstream end of the throttle portion 14*b*. The fuel supply passage 13 and the fuel injection passage 14 are disposed so as to be perpendicular to each other. A diameter of the communication portion 14*a* of the fuel injection passage 14 is larger than that of the fuel supply passage 13.

Figure 2B:
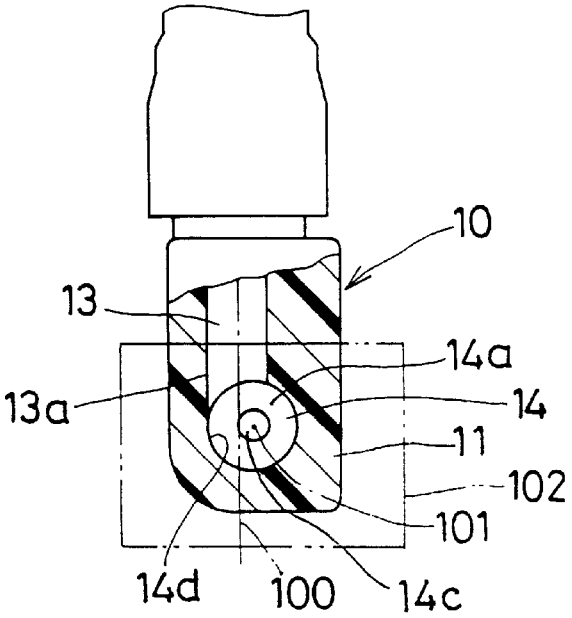
FIG. 2B is a partial cross-sectional view taken along line IIB—IIB in FIG. 2A showing the jet pump according to the first embodiment.

As shown in FIG. 2B, a passage axis 100 of the fuel supply passage 13 and a passage axis 101 of the fuel injection passage 14 are deviated (not on the same plane). In other words, the fuel supply passage 13 and the fuel injection passage 14 are communicated with each other so that each center axis (the passage axis 100 of the fuel supply passage 13 and the passage axis 101 of the fuel injection passage 14) do not cross each other. Further, on a hypothetical plane 102 which includes the passage axis 100 thereon, and extends across the fuel injection passage 14, an outline 13*a* of the fuel supply passage 13 makes contact with an outline 14*d* of the fuel injection passage 14.

Next, operation of the fuel supply system 1 will be described. When the engine is started and an electric current is supplied to the fuel pump 4, the fuel pump 4 sucks fuel in the sub-tank 3 and discharges the fuel outside the fuel tank 2. Surplus fuel returned from the engine is supplied to the jet pump 10 to be returned to the sub-tank 3.

According to the first embodiment, the fuel supply passage 13 and the fuel injection passage 14 in the jet pump 10 are communicated with each other so that the passage axes 100, 101 thereof do not cross each other. Therefore, fuel flowing from the fuel supply passage 13 into the communication portion 14*a* of the fuel injection passage 14 swirls counterclockwise. Further, as shown in FIG. 2B, fuel in the fuel supply passage 13 flows along the outlines 13*a*, 14*d* to be introduced into the fuel injection passage 14 in a manner that prevents turbulence caused by a swirling flow of fuel from occurring in the fuel injection passage 14. Further, since the diameter of the communication portion 14*a* of the fuel injection passage 14 is larger than that of the fuel supply passage 13, a fuel flow from the fuel supply passage 13 to the fuel injection passage 14 is not interrupted by any obstruction. Therefore, energy of fuel flowing through the fuel supply passage 13 is maintained in fuel swirling in the fuel injection passage 14. The swirling flow of fuel in the communication portion 14*a* is throttled in the throttle portion 14*b* to increase its flow rate, and is injected from the injection hole 14*c* with a wide injection angle so that fuel uniformly disperses without turbulence.

Figure 3:
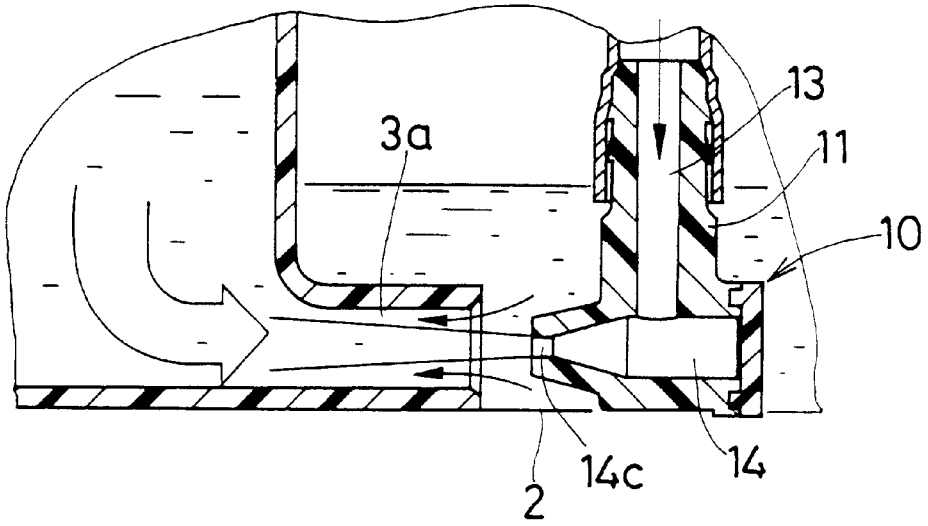
FIG. 3 is a cross-sectional view showing a part of the fuel supply system when fuel exists around the jet pump according to the first embodiment.
Figure 4:
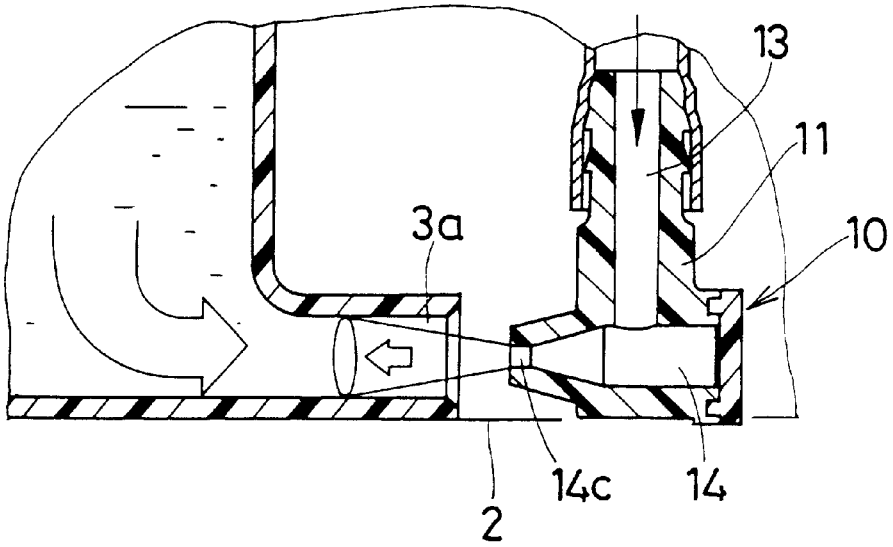
FIG. 4 is a cross-sectional view showing a part of the fuel supply system when fuel is not present around the jet pump according to the first embodiment.

As shown in FIG. 3, when fuel is sufficiently supplied to the fuel tank 2 to fill a space around the injection hole 14*c*, and fuel is injected into the fuel inlet passage 3*a* of the sub-tank 3 by the jet pump 10 through the injection hole 14*c*, fuel in the fuel tank 2 is also sucked into the fuel inlet passage 3*a* due to a negative pressure generated around the injected fuel. At this time, the injected fuel and the sucked fuel from the fuel tank 2 disperses over an entire cross-section of the fuel inlet passage 3*a*, thereby preventing fuel in the sub-tank 3 from being discharged toward the jet pump 10 through the fuel inlet passage 3*a*. Further, fuel in the fuel tank 2 is introduced into the sub-tank 3 in opposition to a water head pressure of fuel in the sub-tank 3 because a pressure of the injected fuel offsets the water head pressure of fuel in the sub-tank 3. As a result, the fuel level in the sub-tank 3 is raised higher than the fuel level in the fuel tank 2 and is maintained at a predetermined level, as shown in FIG. 1.

On the other hand, when fuel in the fuel tank 2 is decreased and the vehicle is steered around a sharp curb or is driven on a road having a steep grade, fuel may not be dispose in the space around the injection hole 14*c* in the fuel tank 2. In this case, only fuel injected by the jet pump 10 is introduced into the fuel inlet passage 3*a*. However, according to the first embodiment, since the injected fuel uniformly disperses at a wide angle, a uniform fuel membrane is formed across the cross-section of the fuel inlet passage 3*a*. Therefore, even when fuel is not present around the injection hole 14*c*, fuel injected from the injection hole 14*c* can be introduced into the sub-tank 3 in opposition to the water head pressure of fuel in the sub-tank 3. Thus, fuel is prevented from being discharged from the sub-tank 3 through the fuel inlet passage 3*a*, thereby maintaining the fuel level in the sub-tank 3. (Second Embodiment)

Figure 5:
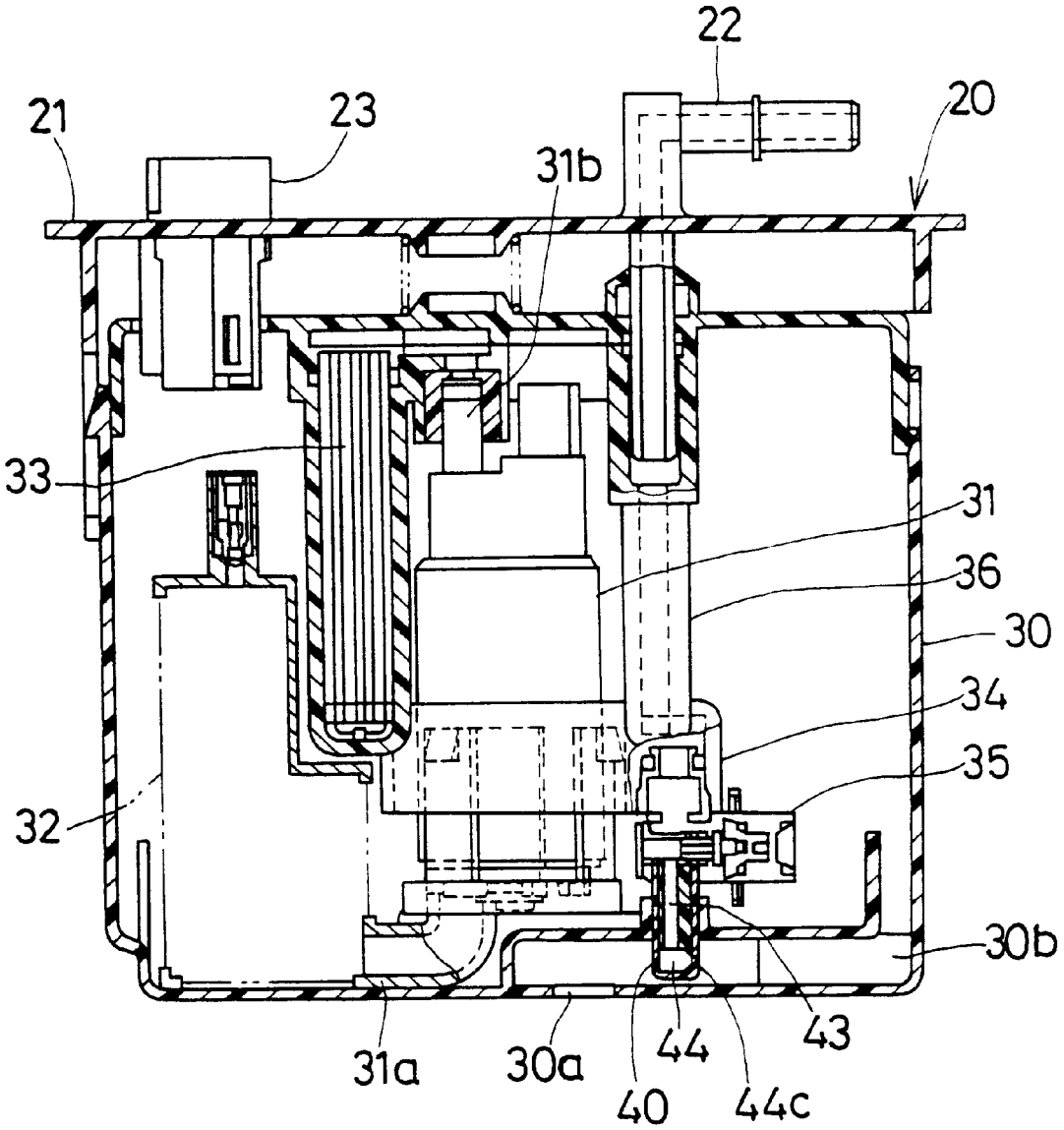
FIG. 5 is a cross-sectional view showing a fuel supply system according to a second embodiment of the present invention.

A second embodiment of the present invention will be described with reference to FIGS. 5–7. As shown in FIG. 5, a fuel supply system 20 according to the second embodiment has a jet pump 40 disposed in a sub-tank 30. A flange portion 21 of the fuel supply system 20 is attached to a fuel tank of the fuel supply system 20. A fuel discharge port 22 and a connector 23 are integrally formed with the flange portion 21. The sub-tank 30 is attached to the flange portion 21 by a snap fastener or the like.

A fuel pump 31 is installed inside the sub-tank 30, and sucks fuel in the sub-tank 30 from a fuel inlet port 31*a* through a fuel filter 32. Fuel sucked by the fuel pump 31 is discharged from a fuel outlet port 31*b* into a branch portion 34 through a fuel filter 33. A pressure of fuel in the branch portion 34 is adjusted by a pressure regulator 35, and then separately flows into a fuel pipe 36 connected to the fuel discharge port 22 and into the jet pump 40.

The jet pump 40 has a fuel supply passage 43 and a fuel injection passage 44. The fuel having a pressure adjusted by the pressure regulator 35 flows through the fuel supply passage 43 and the fuel injection passage 44 in the jet pump 40, and is injected from an injection hole 44*c* of the jet pump 40, thereby generating a negative pressure around the injected fuel. As a result, fuel in the fuel tank is sucked from a fuel inlet port 30*a* formed in the sub-tank 30, and is introduced into a fuel inlet passage 30b formed at a bottom inner part of the sub-tank 30 together with the injected fuel. Thus, a fuel level in the sub-tank 30 is maintained higher than a fuel level in the fuel tank.

Figure 6:
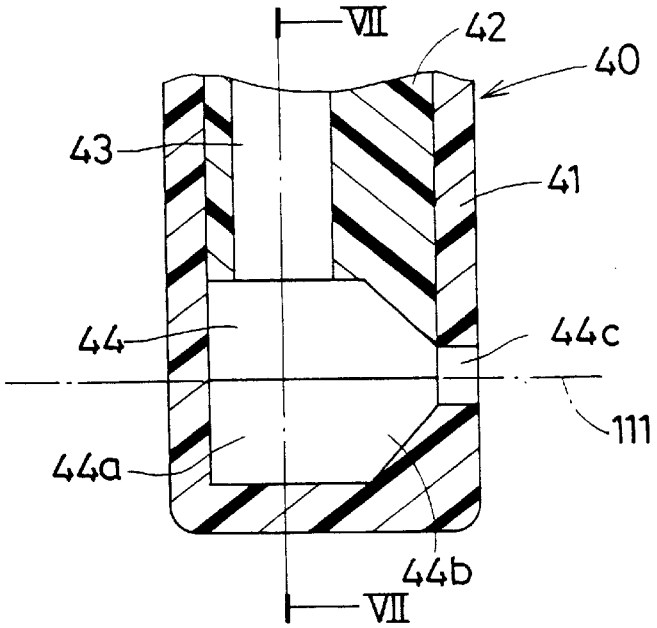
FIG. 6 is a cross-sectional view showing a part of a jet pump according to the second embodiment.
Figure 7:
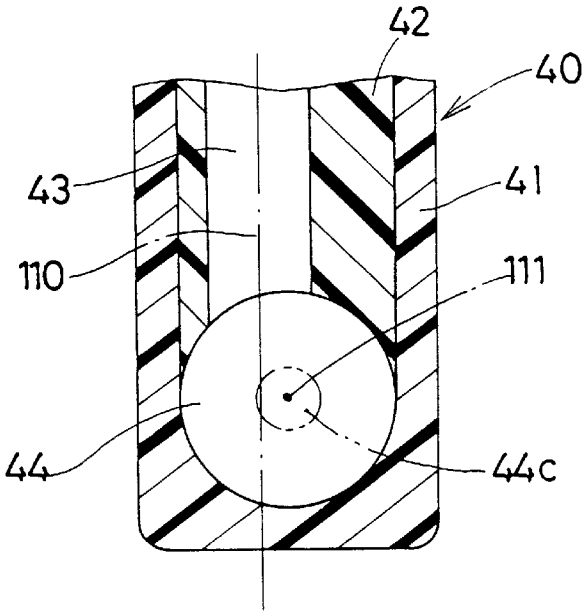
FIG. 7 is a cross-sectional view taken along line VII—VII in FIG. 6 showing a part of the jet pump according to the second embodiment.

As shown in FIG. 6, a housing of the jet pump 40 is made of an outer housing 41 and an inner housing 42 inserted inside the outer housing 41. The fuel supply passage 43 and the fuel injection passage 44 are formed by the housings 41, 42, and are communicated with each other. Further, the fuel supply passage 43 and the fuel injection passage 44 are disposed to be perpendicular to each other. A diameter of the fuel injection passage 44 is larger than that of the fuel supply passage 43 at a communication point between the two passages 43, 44.

The fuel injection passage 44 has a communication portion 44*a* which is communicated with the fuel supply passage 43 and has a constant diameter, a throttle portion 44*b* tapered toward a fuel downstream end, and the injection hole 44*c* formed at the fuel downstream end of the throttle portion 44*b*. A thickness of a wall of the inner housing 42 is not uniform. The fuel supply passage 43 formed inside the inner housing 42 and an outer shape of the inner housing 42 are not co-axial. Therefore, as shown in FIG. 7, a passage axis 110 of the fuel supply passage 43 and a passage axis 111 of the fuel injection passage 44 are not on the same plane. That is, the fuel supply passage 43 and the fuel injection passage 44 are communicated with each other so that the passage axes 110, 111 thereof do not cross each other.

According to the second embodiment, fuel is injected from the injection hole 44*c* of the jet pump 40 at a wide injection angle, and uniformly disperses. Therefore, when fuel does not exist in a space around the injection hole 44*c* in the fuel tank, fuel injected from the injection hole 44*c* uniformly disperses over an entire cross-section of the fuel inlet passage 30*b*, thereby forming a fuel membrane. Therefore, fuel injected from the injection hole 44*c* is introduced into the sub-tank 30 in opposition to a water head pressure of fuel in the sub-tank 30. Thus, even when fuel is not present in the space around the injection hole 44*c*, fuel in the sub-tank 30 is prevented from being discharged from the sub-tank 30 into the fuel tank through the fuel inlet passage 30*b* and the fuel inlet port 30*a*, thereby maintaining a fuel level in the sub-tank 30.

According to the present invention, the fuel supply passage 13 and the fuel injection passage 14 in the jet pump 10 are perpendicular to each other and communicated with each other so that the passage axes 100, 101 thereof do not cross each other. Therefore, fuel flowing into the fuel injection passage 14 from the fuel supply passage 13 swirls, and the injected fuel from the injection hole 14*c* uniformly disperses to form a fuel membrane across the cross-section of the fuel inlet passage 3*a*. As a result, fuel in the fuel tank 2 continues to be introduced into the sub-tank 3 in opposition to the water head pressure of fuel in the sub-tank 3 even when fuel does not exist in the space around the injection hole 14*c*. Thus, fuel in the sub-tank 3 can be constantly supplied to the engine by the fuel pump 4 sufficiently.

Further, the jet pump 10 causes fuel to swirl, and has a simple structure in which the passage axes 100, 101 do not cross each other. Therefore, the jet pump 10, 40 is manufactured easily at a low production cost.

In the present invention, the diameter of the fuel injection passage 14 is larger than the diameter of the fuel supply passage 13. Therefore, fuel in the fuel supply passage 13 is smoothly introduced into the fuel injection passage 14 without being interrupted by any obstruction. As a result, an energy of fuel in the fuel supply passage 13 is maintained in fuel swirling in the fuel injection passage 14. Therefore, fuel effectively disperses at a wide angle when being injected from the injection hole 14*c*.

A diameter of the injection hole 14*c* may be decreased so that the negative pressure generated around the injected fuel is increased. In this case, the injected fuel still disperses over the cross-section of the fuel inlet passage 3*a*, thereby preventing fuel from being discharged from the sub-tank 3 even if fuel does not exist in a space around the injection hole 14*c*. Further, the diameter of the fuel inlet passage 3*a* of the sub-tank 3 may be increased so that fuel is more easily introduced into the sub-tank 3. In this case, by suitably designing the passages 13, 14 of the jet pump 10, fuel can be prevented from being discharged from the sub-tank 3 while the jet pump 10 sufficiently introduces fuel into the sub-tank 3. Thus, the fuel supply system design is flexible.

The fuel supply passage 13 and the fuel injection passage 14 may cross each other at a predetermined angle except 90 degrees, provided that the passage axis 100 of the passage 13 and the passage axis 101 of the passage 14 do not cross each other. The diameter of the fuel injection passage 14 may be equal to or smaller than that of the fuel supply passage 13, provided that the passage axis 100 of the passage 13 and the passage axis 101 of the passage 14 do not cross each other.

In the present invention, the jet pump 10 is formed separately from the sub-tank 3 and is disposed outside the sub-tank 3. However, the jet pump 10 may be integrally formed with the sub-tank 3.

The above discussion is also applicable to the components in the second embodiment of the present invention.

Although the present invention has been fully described in connection with preferred embodiments thereof with reference to the accompanying drawings, it is to be noted that various changes and modifications will become apparent to those skilled in the art.

Such changes and modifications are to be understood as being within the scope of the present invention as defined by the appended claims.

What is claimed is:

1. A fuel supply apparatus for a fuel tank, comprising:

a sub-tank disposed within the fuel tank, and having a fuel inlet passage through which fuel in the fuel tank is introduced into said sub-tank;

a fuel pump disposed within said sub-tank for sucking fuel in said sub-tank and for discharging said fuel; and a jet pump for injecting fuel into the sub-tank and for delivering fuel from the fuel tank into said sub-tank through said fuel inlet passage using a negative pressure generated by said fuel injection; wherein, said jet pump includes a fuel supply passage and a fuel injection passage disposed downstream in a fuel flow direction from said fuel supply passage, an injection passage axis of said fuel injection passage being disposed at a predetermined angle to a supply passage axis of said fuel supply passage for injecting fuel received from said fuel supply passage into said sub-tank, said fuel injection passage axis deviated from said supply passage axis so that said passage axes do not intersect, said fuel injection passage having a passage diameter larger than a passage diameter of said fuel supply passage at a point where said fuel supply passage and said fuel injection passage are in communication with each other.

2. A fuel supply apparatus according to claim 1, wherein said predetermined angle is ninety degrees.

3. A fuel supply apparatus according to claim 1, wherein a part of an inner wall of said fuel supply passage is contiguous with a part of an inner wall of said fuel injection passage on a hypothetical plane that includes said supply passage axis and crosses said fuel injection passage axis.

4. A fuel supply apparatus for a fuel tank, comprising:

a sub-tank disposed within the fuel tank, and having a fuel inlet passage through which fuel in the fuel tank is introduced into said sub-tank;

a fuel pump disposed within said sub-tank for sucking fuel in said sub-tank and for discharging said fuel to an outside of said sub-tank; and a jet-pump for injecting fuel into the sub-tank to deliver fuel in the fuel tank into said sub-tank through said fuel inlet port via a negative pressure generated by said fuel injection; wherein, said jet pump includes a fuel supply passage;

said jet pump includes a fuel injection passage disposed at a downstream side of said fuel supply passage and having a passage axis disposed at a predetermined angle with respect to a passage axis of said fuel supply passage whereby fuel conveyed through the fuel supply passage is injected into the sub-tank;

said passage axis of said fuel injection passage being laterally offset from said passage axis of said fuel supply passage such that said passage axis of said fuel injection passage and said passage axis of said fuel supply passage do not intersect; and said fuel injection passage has a diameter which is greater than a diameter of said fuel supply passage at a point where said fuel supply passage and said fuel injection passage are in communication with each other.

5. A fuel supply apparatus according to claim 4, wherein said predetermined angle is ninety degrees.

6. A fuel supply apparatus according to claim 4, wherein a part of an inner wall of said fuel supply passage is contiguous with a part of an inner wall of said fuel injection passage on a hypothetical plane that includes said passage axis of said fuel supply passage and crosses said passage axis of said fuel injection passage.

7. A sub-tank system for fuel supply apparatus, comprising:

a sub-tank disposed within the fuel tank having an inlet passage member defining an inlet passage on a lower portion of said sub-tank; and a jet-pump member having an injection hole, a supply passage located upstream of said injection hole, a communication portion located between said injection hole and said supply passage defining a circular-shaped chamber having a diameter larger than said injection hole, and a fuel throttle portion located between said injection hole and said communication portion, wherein:

said injection hole has an injection axis coaxially disposed with respect to said inlet passage, said injection hole, said throttle passage and said communication portion are located coaxially with said injection axis; and said supply passage is communicated with said circular-shaped chamber defined by said communication portion so that a supply axis of said supply passage makes approximately a right angle with said injection axis and is deviated from said injection axis so that said supply axis does not intersect said injection axis.

8. A sub-tank system according to claim 7, further comprising:

a fuel pump having a fuel discharge port which is in communication with said supply passage.

9. A sub-tank system according to claim 7, wherein said jet pump member is inserted into said inlet passage from an outside of said inlet passage member.

10. A sub-tank system according to claim 7, wherein said inlet passage member is integrally formed with said sub-tank, and said jet pump member is assembled with said inlet passage member.

11. A sub-tank system according to claim 7, wherein said jet pump member comprises:

a first housing portion defining a part of said communication portion, and a second housing portion defining a remaining part of said communication portion and said supply passage.

12. A sub-tank system according to claim 7, wherein said jet pump member comprises:

an outer housing portion defining said injection hole and a lower side of said throttle portion and said communication portion, and an inner housing portion defining said supply passage and a remaining upper side of said throttle portion and said communication portion.

13. An apparatus according to claim 1, wherein said injection passage of said jet-pump includes a communication portion for receiving fuel from said fuel supply passage, an injection hole coaxial to said communication portion and a fuel throttle portion disposed between said injection hole and said communication portion, said fuel throttle portion defining a gradually reducing flow passage area between said communication portion and said injection hole.

14. An apparatus according to claim 1, wherein said fuel inlet passage of said sub-tank has a flow passage diameter greater than said passage diameter of said fuel injection passage at said point where said fuel supply passage and said fuel injection passage are in communication with each other.

15. An apparatus according to claim 4, wherein said injection passage of said jet-pump includes a communication portion for receiving fuel from said fuel supply passage, an injection hole coaxial to said communication portion and a fuel throttle portion disposed between said injection hole and said communication portion, said fuel throttle portion defining a gradually reducing flow passage area between said communication portion and said injection hole.

16. An apparatus according to claim 4, wherein said fuel inlet passage of said sub-tank has a flow passage diameter greater than said diameter of said fuel injection passage at said point where said fuel supply passage and said fuel injection passage are in communication with each other.

* * * * *